US005240404A

United States Patent [19]

Hemsath et al.

[11] Patent Number: 5,240,404

[45] Date of Patent: Aug. 31, 1993

[54] ULTRA LOW $NO_x$ INDUSTRIAL BURNER

[75] Inventors: Klaus H. Hemsath, Toledo; Arvind C. Thekdi, Sylvania, both of Ohio

[73] Assignee: Southern California Gas Company, Los Angeles, Calif.

[21] Appl. No.: 829,713

[22] Filed: Feb. 3, 1992

[51] Int. Cl.[5] ..... F23M 3/00

[52] U.S. Cl. ..... 431/9; 431/11; 431/185; 431/352; 239/399; 239/401

[58] Field of Search ..... 431/159, 160, 181, 8, 431/11, 9, 12, 207, 173, 350, 352; 60/757; 239/401, 399; 432/12, 121, 138

[56] References Cited

U.S. PATENT DOCUMENTS

| | | | |
|---|---|---|---|
| 3,782,883 | 1/1974 | Nesbitt et al. | 431/185 |
| 3,819,323 | 6/1974 | Hemsath et al. | 432/138 |
| 3,951,584 | 4/1976 | Thekdi | 431/352 |
| 4,214,866 | 7/1980 | Thekdi et al. | 432/12 |
| 4,629,416 | 12/1986 | Voorheis | 431/352 |
| 5,052,921 | 10/1991 | Hemsath | 432/121 |

*Primary Examiner*—Larry Jones
*Attorney, Agent, or Firm*—Body, Vickers & Daniels

[57] ABSTRACT

An industrial gas burner is disclosed which operates at low air/fuel ratios to avoid $NO_x$ formation without carbon sooting. The burner includes a refractory block having a cylindrically stepped throat passage extending therethrough, a housing adjacent the inlet end of the refractory block and a swirl plate inbetween the block and housing. Vane passages in the swirl plate provide fluid communication between the throat passage and an annular entrainment passage in the housing. A plurality of circumferentially spaced gas jet nozzles in the entrainment passage cause jet entrainment and mixing of fuel and combustion air which is ported to the entrainment chamber. The jet streams of mixed air/fuel impinge the swirl plate whereat the mixture undergoes a further mixing because of the pressure drop and swirling therein. The swirling air/fuel mixture is thus intimately and thoroughly mixed when it exits the swirl plate as a swirling mass at the entry end of the throat passage where it is ignited. The mixing is so intimate that combustion of the air/fuel can occur at ratios as low as 5 to 1 without carbon sooting and $NO_x$ formation.

22 Claims, 2 Drawing Sheets

ULTRA LOW $NO_x$ INDUSTRIAL BURNER

This invention relates generally to industrial, gas-fired burners and more particularly to a burner which produces little, if any, $NO_x$ compounds in its products of combustion.

The burner is particularly applicable to and will be described with specific reference to its ability to literally produce no $NO_x$ emissions, but it will be appreciated by those skilled in the art that the invention has broader applications and the burner can be operated at high excess air and turn down ratios which may produce some $NO_x$ emissions but at levels within $NO_x$ emission regulations.

INCORPORATION BY REFERENCE

My U.S. Pat. No. 5,052,921 entitled "Method and Apparatus for Reducing $NO_x$ Emissions in Industrial Thermal Processes" dated Oct. 1, 1991, and my U.S. Pat. No. 3,782,883 entitled "Flat Flame Burner Having a Low Air to Gas Ratio" dated Jan. 1, 1974 and my U.S. Pat. No. 3,819,323 entitled "Minimum Scale Reheating Furnace and Means Relating Thereto" dated Jun. 25, 1974 are incorporated in their entirety by reference herein so that concepts and details known in the prior art need not be set forth with particularity herein.

BACKGROUND

As used herein, "$NO_x$" means the various compounds of nitrous oxide such as NO, $NO_2$, $N_2O$ etc. "Gas fired" or "gaseous fuel" means natural gas (including methane and small percentages of other elements commonly referred to as "street gas") and its higher order hydrocarbon derivatives such as butane, propane etc. "Turn down" will be used herein in the sense of air to fuel ratios and will refer to the ability of the burner to operate over a range of air to fuel ratios. "Combustion air" means the air we breathe in the atmosphere which contains some percentage of $O_2$. This invention relates to a gas-fired burner producing little if any $NO_x$ emissions and specifically emissions low enough to meet currently contemplated standards such as those proposed in California which limit $NO_x$ emissions for industrial processes to 9 ppm.

In FIG. 2 of my '921 patent is a graph showing products of combustion and percentages thereof when a burner is operated at various air/fuel ratios including stoichiometric. In FIG. 3 of my '921 patent is a graph illustrating $NO_x$ compounds produced when an industrial burner is operated at various air/fuel ratios. In the text of the '921 patent, I discuss the beneficial effect of the presence of combustibles i.e. $H_2$ and CO, produced by burners operating at low air/fuel ratios in preventing or retarding the formation of $NO_x$ compounds. It is also discussed that operating burners at low air/fuel ratios drops the adiabatic flame temperature of the burner to temperatures less than 2800° F. and that at flame temperatures of less than 2800° F., $NO_x$ formation will not occur whether or not combustibles such as $H_2$ or CO are or are not present.

Finally, FIG. 5 of my '921 patent shows the adverse effects of preheated combustion air on $NO_x$ formation and discloses that air/fuel ratios in the range of 6 to 1 which would not produce $NO_x$ with cold air have to be lowered to the range of 5 to 1 if preheated combustion air is utilized. As is well known in the burner art, use of preheated combustion air, whether as secondary or primary combustion air, is desirable for fuel efficiencies.

My '883 patent discloses a burner which can operate at air/fuel ratios as low as 6.5 to 1 with cold air. In the '883 patent I tangentially inject into a cup shaped or cylindrical throat chamber a swirling mass of fuel/air mixture which is ignited therein. I sized the tangential injection opening to the throat chamber to be smaller than a chamber into which the air and fuel is admitted to create a back pressure which causes mixing of the air and fuel prior to being injected into the cup shaped throat chamber. The mixing of the air and fuel was sufficient to sustain ignition at air/fuel ratios which, at the time, were very low. However the mixing in the '883 device was not sufficient to prevent carbon formation or sooting at air/fuel ratios lower than 6.5 to 1 with cold air. Additionally, because of the lack of complete air fuel mixing prior to ignition, there was a tendency in the '883 burner to produce local adiabatic flame temperatures higher than 2800° F. at air/fuel ratios lower than what otherwise would be possible because of further mixing of the air and fuel at the flame stabilization point in the burner.

With respect to prior art industrial burners operating at stoichiometric or excess air ratios, in my U.S. Pat. No. 4,214,866 there is disclosed a jet of combustion air actuating a swirler to cause mixing which progressively occurs downstream of the ignition point. With respect to a stoichiometrically operated burner which addresses the problems of carbon soot formation, reference can be had to Thekdi U.S. Pat. No. 3,951,584 which discloses a secondary air combustion zone which recirculates air back into a rich combustion zone to prevent carbon formation. Generally speaking, stoichiometric burners such as disclosed in the '866 and '584 patents, generate a fuel/air mixture which is capable of being ignited and then use various types of flow patterns, most often produced in combination with burner configuration, to cause thorough mixing of the fuel/air mixture as it longitudinally travels through or out of the burner. As noted, my '883 patent is distinguished from the other cited patents in that mixing of fuel/air occurred, at least partially, prior to ignition and this leads to the ability of the '883 patent to produce a burner which is capable of igniting low air/fuel ratios or ratios prior to this invention, which were considered low air/fuel ratios.

SUMMARY OF THE INVENTION

It is thus a principle object of the present invention to provide method and apparatus for combusting mixtures having low air/fuel ratios without carbon sooting and without forming anything more than insignificant trace amounts of $NO_x$ compounds.

This object along with other features of the invention is achieved in a low $NO_x$ industrial burner which includes a refractory burner block having a throat passage longitudinally extending therethrough from an entry end to an exit end. A longitudinally extending burner housing generally adjacent the burner block has an annular entrainment passageway formed therein with the entrainment passage open at one axial end and closed at its opposite axial end and generally concentric with the throat passage. An air preheat chamber is in fluid communication with the entrainment passage and a plurality of gas jet nozzles are circumferentially spaced in increments within the entrainment passage with each nozzle having a jet axis orientated generally parallel to the entrainment passage's longitudinal axis. A gas swirl plate is interposed between the open end of the entrainment passage and the burner block and has a plurality of radially extending vane passages with each vane passage in fluid communication with the throat passage and the entrainment passage. Conventional mechanisms are provided for supplying combustion air, preferably preheated, to the preheat chamber and gas under pressure to the gas jets for causing gas from the gas jets to thoroughly mix with combustion air in the entrainment passage and in the vane passages into a combustible mixture at the entry end of the throat passage where an ignition means ignites the air/fuel mixture thus permitting low air/fuel ratios to be ignited and combusted in the industrial burner at adiabatic temperatures whereat $NO_x$ formation does not occur.

In accordance with another important feature of the invention, the swirl plate has a central opening concentric with the throat passageway and an annular base portion which extends radially outwardly from the opening with a plurality of radially extending vane segments protruding longitudinally from the base portion to define a plurality of vane chambers between adjacent vane segments. Each vane chamber has an area which progressively increases as the radial distance of the vane chamber extends further away from. the central opening thus causing a pressure drop at the throat passageway which produces further mixing of the fuel-/air mixture previously mixed by the jet entrainment described above resulting in a thorough or complete mixing of the fuel/air mixture prior to ignition to minimize carbon soot formation.

In accordance with another aspect of the invention, the vane segments extend tangentially from the central opening so that a swirl is imparted to the fuel/air mixture when it enters the throat passage. Still more specifically the throat passage is cylindrical in shape and has a first longitudinally extending section of a first diameter adjacent to its entry end, a second longitudinally extending sect adjacent its exit end of diameter larger than the first diameter, and an intermediate frusto conical, step section between the first and second section whereby the intersection of the second section with the step section provides a flame stabilization point for the burner producing a short flame front while the swirl permits the burner to operate over a wide turn-down range.

In accordance with a still more specific feature of the invention, the swirl plate has a longitudinally offset collar portion and the housing has a gas chamber in fluid communication with the collar portion with a dividing wall in the gas chamber which divides the gas chamber into a high pressure chamber in fluid communication with the collar portion and a receiving chamber adjacent the high pressure chamber. The gas jet nozzles include a jet tube extending from the jet nozzle into the high pressure chamber and apertures are provided in the dividing wall for directing jet streams of gaseous fuel into the high pressure chamber for pressurizing the high pressure chamber and simultaneously impinging the collar portion of the swirl plate whereby cooling of the swirl plate occurs by natural gas at ambient temperature so that the swirl plate need not be formed of ceramic or other high temperature resistant material. Specifically, cooling of the swirl plate permits the entire burner housing casing including an integral swirl plate to be formed by one inexpensive casting.

In accordance with another aspect of the invention an industrial burner apparatus is provided which includes a refractory burner block having a longitudinally extending throat passage which extends therethrough and a longitudinally extending burner housing which is adjacent the block and which housing also has a longitudinally extending annular entrainment passage formed therein. A mechanism is provided to supply preheated primary combustion air to the entrainment passage at temperatures as high as about 1250° F. A mechanism is also provided to supply gaseous fuel to the burner housing. A gas jet mechanism in fluid communication with the gas supply mechanism forms a plurality of circumferentially spaced jet streams of gaseous fuel within the entrainment passage for entraining and mixing the fuel and air in the entrainment passage into a combustible fuel/air mixture. A swirl mechanism interposed between the housing and the block provides fluid communication between the entrainment passage and the throat passage and is effective to cause swirling and further mixing of the fuel/air mixture and an ignitor adjacent the swirl mechanism within the throat passage is provided for igniting the fuel/air mixture. A controller regulates the supply of preheated air and the gaseous fuel to be admitted into the entrainment chamber at ratios as low as 5 parts of combustion air to 1 part of natural gas so that the burner produces products of combustion which are rich in combustibles at such low air/fuel ratios where $NO_x$ formation does not occur.

In accordance with another aspect of the invention a method is provided for combusting a gaseous fuel with preheated air to produce products of combustion substantially free of $NO_x$ compounds which method includes the steps of providing a refractory burner block with a throat passage extending therethrough, a burner housing having an annular entrainment passage adjacent the block and a swirl plate interposed between the housing and the block providing fluid communication between the throat and entrainment passages. Preheated air at temperatures of up to about 1250° F. is supplied to the entrainment passage and fuel is furnished as free standing gas jets in the entrainment passage. The gas jets are directed towards the swirl plate to cause precise entrainment of air within the fuel jet and mixing therebetween as the entrained jet streams of fuel and air radially expand into contact with the entrainment passage walls to cause thorough mixing thereof in a short longitudinal distance. The mixed streams of fuel/air mixture then impinge the swirl plate and are swirled while undergoing a pressure drop in the swirl plate to be thoroughly and completely mixed into a combustible mixture of fuel/air when the fuel/air mixture leaves the swirl plate and enters the throat passage whereat the fuel/air mixture is ignited as it leaves the swirl plate. The ratio of fuel and air supplied to the burner is controlled to be anywhere within the range of about 5 to 12 parts of combustion air to 1 part of natural gas whereby the products of combustion produced by the burner when the burner is operated substoichiometrically include combustibles such as CO and $H_2$ in quantities sufficiently high to prevent $NO_x$ formation which otherwise occurs when adiabatic flame temperatures in excess of about 2800° F. are encountered in the combustion gases. Significantly the air/fuel mixture is so thoroughly mixed that recirculation of the mixture at the burner stabilization point does not produce temperature spikes which would otherwise form $NO_x$ compounds.

It is thus a principle object of the invention to provide an industrial burner and/or method of combustion which produces products of combustion substantially free of $NO_x$ compounds when operated of substoichiometric air/fuel ratios.

It is another object of the present invention to provide an industrial burner and/or combustion method which is capable of burning quantities of air/fuel at ratios which are lower than that heretofore possible.

It is still yet another feature of the invention to provide an industrial burner or a method of combustion which does not produce carbon soot.

Still yet another object of the invention is to provide a burner which is very stable and can be operated over a wide turn down ratio and specifically a ratio which can vary anywhere from 5 parts of air to 1 part of natural gas to 10–12 parts of air to 1 part of natural gas.

Still another object of the invention is to produce a low cost burner.

Still yet another object of the invention is to provide a low $NO_x$ industrial burner which avoids any use of costly ceramics and uses in its construction conventional, furnace-type fibrous insulation.

Still yet another object of the invention is to provide a burner and a method for combusting air/fuel without producing significant $NO_x$ formation but which uses preheated air as the primary combustion air for the burner.

Still yet another object of the invention is to provide an industrial burner and/or method of combustion which is capable of providing any one or more of the following in any combination thereof:

i) Very low $NO_x$ generations;

ii) Very high combustion air temperature;

iii) Very low air/fuel ratio; and iv) No soot formation.

Still yet another specific object of the invention is to provide an industrial gas burner which contains the following features or any combination thereof:

i) The air ducting and the burner are internally insulated;

ii) Natural gas is used to cool the most massive burner parts;

iii) Swirl is used to maintain stability at low air/fuel ratios over a wide turn down range;

iv) Gas and hot air are intimately mixed in a very short time and distance but before ignition can occur; and v) Burner geometry makes placement of spark igniter, flame supervision sensor and sight glass easy to arrange.

A still further object of the invention is the provision of a burner which produces products of combustion rich in combustibles which combustibles can be easily combusted without temperature spiking by conventional staged combustion techniques.

These and other objects of the invention will become apparent to those skilled in the art upon reading and understanding the detailed description of the preferred embodiment of the invention set forth below.

BRIEF DESCRIPTION OF THE DRAWINGS

The invention may take physical form in certain parts and arrangement of parts, a preferred embodiment of which will be described in detail herein and illustrated in the accompanying drawings which form a part hereof and wherein.

DETAILED DESCRIPTION OF THE PREFERRED EMBODIMENT

Figure 1:
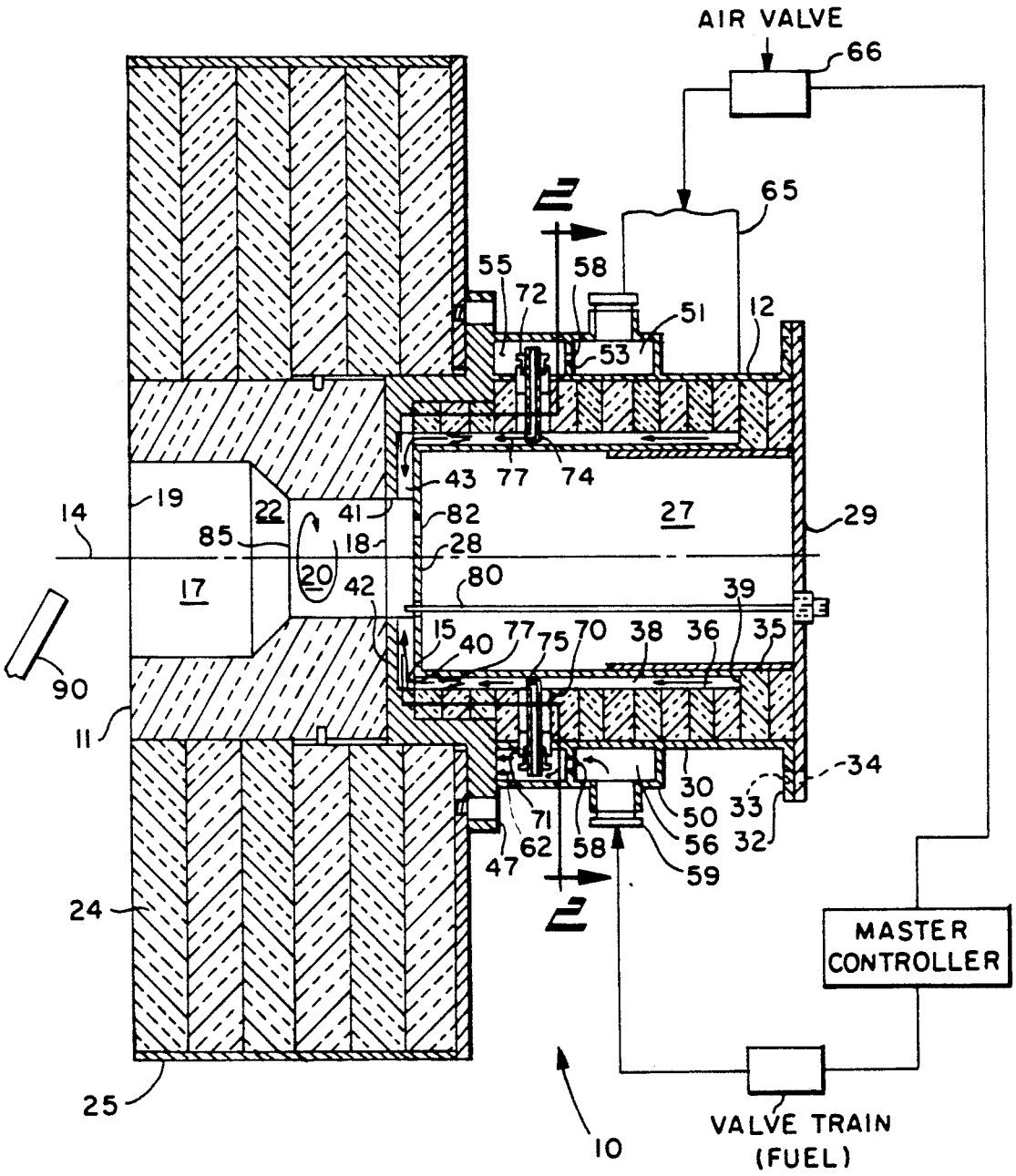
FIG. 1 is a longitudinally-sectioned schematic representation of the principle portion of the burner of the present invention.

Referring now to the drawings wherein the showings are for the purpose of illustrating the preferred embodiment of the invention only and not for the purpose of limiting same, there is shown a burner 10 which includes a longitudinally extending refractory block 11, preferably formed from refractory brick, and a longitudinally extending burner housing 12. Block 11 and housing 12 are generally symmetrical or concentric about a longitudinally extending center line 14. Interposed between block 11 and housing 12 is a swirl plate 15 which in the preferred embodiment is formed as a casting from high temperature resistant alloy steel and which is configured or cast to form the outer casing of housing 12.

Refractory block 11 has a central throat passage 17 extending therethrough from an entry end 18 to an exit end 19. More specifically, throat passage 17 has a first cylindrical section 20 extending from entry end 18, a second cylindrical section 17 extending from exit end 19 and an intermediate section 22 between cylindrical sections 20, 17. Intermediate section 22 is frusto conical in configuration and tapers at an angle of about 45° from first cylindrical section 20 to second cylindrical section 21. Burner 10 in the preferred embodiment has an output of 2 Btu/hr. and for that size burner, the diameter of first cylindrical section 20 is 4 inches and the diameter of second cylindrical section 21 is 7 inches and the length of first cylindrical section 21 is about 3 1/16 inch. Other burner dimensions specified herein are based on a burner design having the stated output.

Extending radially outwardly from refractory block 11 is a plurality of strips of conventional fibrous, blanket insulation 24 in 2" thick sections applied between refractory block 11 and burner casing 25 which is typically 3/16" plain carbon steel plate having an outside diameter, for the burner illustrated, of about 50 inches.

Housing 12 includes an interior hollow cylinder 27 (about 12" in length for the specified burner) which has an inside closed axial end 28 which abuts swirl plate 15 and an outside closed axial end 29. Concentric with interior cylinder 27 is outside cylindrical casing portion 30 of housing 12. In the preferred embodiment housing casing portion 30 is part of swirl plate 15, but it is recognized that if housing 12 were fabricated then outside casing portion 30 would extend from swirl plate 15 as a cylinder and surround interior cylinder 27. Outside casing 30 is flanged at 32 so that fasteners (not shown) extending through aligned holes 33 in outside casing portion 30 and holes 34 in outside closed end 29 can secure interior cylinder 27 to outside casing portion 30 of housing 12.

In the annular space between outside casing portion 30 and interior cylinder 27 is a plurality of vacuum formed, fibrous insulation boards 35 of about 1"2" thickness. This is a conventional vacuum formed, ceramic fiber insulation of relatively high density i.e. 15 pounds/ft.$^2$ with the cylindrical surface or longitudinally extending surfaces of the insulation sprayed with a conventional silica sand mixture to make it hard and rigid. The insulation is secured to outer casing portion 30 in a conventional manner (not shown). As best shown in FIG. 1 fibrous insulation 35 does not extend into contact with interior cylinder 27 over a longitudinal distance which spans or extends from inside closed axial end 28 of interior cylinder 27 (or swirl plate 15) to a distance spaced from outside closed axial end 29 of interior cylinder 27. The spacing between radially innermost edges 36 of fibrous insulation 35 and interior cylinder 27 defines an annular entrainment passage 38. Entrainment passage 38 has a closed axial end 39 adjacent or spaced from outside closed axial end 29 of interior cylinder 27. Entrainment passage 38 has an open axial end 40 in fluid communication with swirl plate 15. Thus entrainment passage 38 is a sealed passage in fluid communication with swirl plate 15.

Figure 2:
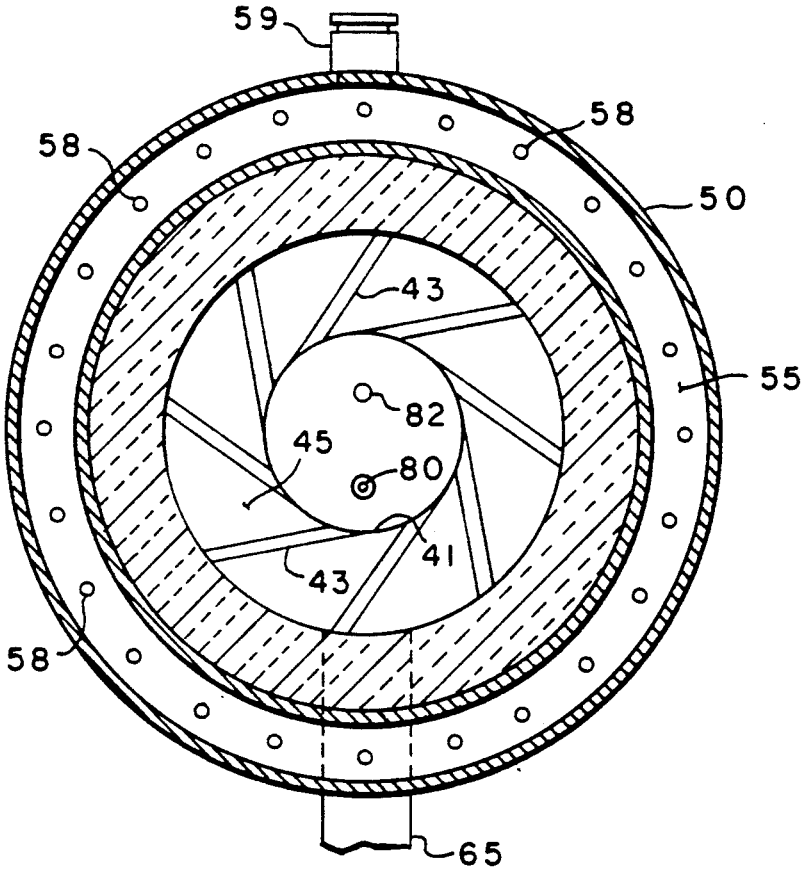
FIG. 2 is a sectioned view of the burner illustrated in FIG. 1 taking along lines 2—2 thereof.

Swirl plate 15 has a cylindrical, central opening 41 which is co-axial with longitudinal centerline 14 and of the same diameter as first cylindrical section 20. Swirl plate 15 has a longitudinally extending base portion 42 which radially extends from central opening 41 at entry end 18 of throat passage 17 in block 11 to entrainment passage 38. Longitudinally extending from base portion 42 towards closed axial end 28 is a plurality of vane segments 43 (best shown in FIG. 2) which abut against closed axial end 28 of interior cylinder 27 and which radially extend from throat passage 17 to entrainment passage 38. Vane segments 43 which are adjacent one another define vane chambers 45. Each vane chamber 45 is in fluid communication at its radially outermost end with entrainment passage 38 and is in fluid communication at its innermost end with entry end 18 of central throat passage 17. Each vane chamber 45 decreases in area as it extends radially inwardly toward central opening 41 thus resulting in a pressure drop and an increase in velocity as the fuel/air mixture travels from entrainment passage 38 radially inwardly in vane chambers 45 until exiting into central throat passage 17. Furthermore, each vane segment 43 is tangential to central opening 41 and adjacent vane segments 43 form an included angle of 45° in the preferred embodiment of the invention. As shown in FIG. 2, there are 8 vane chambers 45 and 8 vane segments 43. Other vane chamber configurations are possible. However, the point to be made is that adjacent vane segments 43 at central opening 41 form very small exit openings (because of the tangential construction) which act as orifices and induce a back pressure in vane chambers 45 which is significant and which causes further mixing of the air and fuel therein. Furthermore, to impart a swirl to the fuel/air mixture travelling radially inwardly through vane chambers 45 to throat passage 17, adjacent vane segments form an included angle of 45°. Also, and not shown in the drawings, it is desired that the swirling mass of fuel/air mixture when leaving swirl plate 15 enter throat passage 17 with a longitudinal velocity component so that the mixture travels from entry end 18 to exit end 19 of throat passage 17. To achieve this, the vane segments 43 are pitched relative to base portion 42 or protrude at an angle relative to base portion 42 i.e. not perpendicular thereto. The degree at which vane segments are pitched or canted is a function of the speed of the swirl which in turn is a function of jet velocity to be discussed hereafter and is predetermined.

As indicated above, it is desired for cost efficiency that swirl plate 15 be constructed of a standard high temperature steel to avoid an expensive ceramic refractory construction, which because of shock and vibration, might not be suitable in terms of durability for application to an industrial burner. In the preferred embodiment, swirl plate 15 in addition to its base portion 42 and vane segments 43 has a collar portion 47 which attaches to burner casing 25 and collar portion 47 is relatively thick for heat conductive purposes. In addition, longitudinally extending from collar portion 47 is outside cylindrical casing portion 30 so that in the preferred embodiment of the invention, housing 12 is actually formed from a single casting which includes swirl plate 15 and into which is inserted interior cylinder 27 for a very simple construction.

Longitudinally extending from collar portion 47 is a gas wall portion 50 which is disposed radially outwardly from outside cylindrical casing portion 30 to define an annular gas chamber 51. The annular gas chamber 51 in turn is divided by dividing wall portion 53 radially extending from gas wall portion 50 to outside cylindrical casing portion 30 into a high pressure gas chamber 55 adjacent to collar portion 47 and a gas distribution chamber 56 adjacent to high pressure chamber 55. A plurality of apertures 58 or orifices are circumferentially spaced about dividing wall portion 53 and provide fluid communication from gas distribution chamber 56 to high pressure chamber 55. At least one gas fitting 59 is provided for gas distribution chamber 56 so that a source of natural gas supplied under pressure from a conventional valve train 60 can be ported at a controlled pressure and mass rate of flow into gas distribution chamber 56. From gas distribution chamber 56 natural gas is then directed as high speed jet gas streams at ambient temperature through apertures 58 to impinge collar portion 47 as shown by arrows indicated by reference numerals 62. Thus, natural gas at ambient temperature impinges collar portion 47 which because of its thick construction acts as a heat sink to conduct heat from base portion 42 and vane segments 43 so that the temperature of swirl plate 15 does not become high enough to adversely effect the physical and metallurgical properties and characteristics of swirl plate 15 when formed of standard stainless steel casting. This significantly reduces the cost of burner 10 while at the same time permitting burner 10 to withstand vibration and other shock loadings normally imparted to swirl plate 15 and burner 10. In addition heat is added to the fuel prior to combustion which increases burner efficiency.

An air duct 65 is in fluid communication with entrainment passage 38 and injects preheated, primary combustion air into entrainment passage 38 adjacent its closed axial end 39. A valve 66 controls the mass rate flow of preheated air into air duct 65. Valve train 60 and valve 66 are under the control of master controller 68 which, among other things, establishes the effective flow rate and pressures at which fuel and primary, preheated combustion air is admitted to entrainment passage 38.

Extending within insulation 35 between entrainment passage 38 and gas pressure chamber 58 is a plurality of radially extending passages 70. In the preferred embodiment there are 8 passages 70 because there are 8 vane chambers 45. Other numbers are possible. Inserted into each passage 70 is a stainless steel half coupling 71 which threadingly receives a stainless pipe plug 72. The pipe plug coupling 71, 72 holds firmly and sealingly in place a nozzle tube 74 which extends from pressure chamber 55 and terminates at jet nozzle 75 in entrainment passage 38. Jet nozzle 75 is orientated to direct its jet longitudinally within entrainment passage 38 in a direction parallel to longitudinal axis 14 so that the jet expands into impingement contact with vane chambers 45 as shown by arrows indicated by reference numeral 77. In the preferred embodiment there are 8 jet nozzles. Other numbers are possible. In the burner illustrated in the preferred embodiment the inside diameter of entrainment passage 38 is about 8 inches and the outside diameter of entrainment passage 38 is 9 inches establishing a one-half inch radially extending width of entrainment passage 38. The diameter of jet nozzle 75 is 0.125 inches in diameter. The jet 77 emanating from jet nozzle 75 is a free standing conical jet which expands into contact with interior cylinder 27 and refractory edge 36 prior to contact with vane chamber 45. The jet speed of fuel emanating from jet nozzle 75 is in excess of 10,000 feet per minute. At this speed the jet entrains combustion air from air duct 65 and in fact the amount of entrainment is controlled by the speed of the jet. When the jet radially expands with the now entrained fuel/air mixture into contact with interior cylinder 27 and insulation wall 36, the precisely entrained mixture of fuel and air is mixed by turbulent contact. More specifically, first there is jet entrainment to establish a precise ratio of fuel and air depending upon the jet velocity followed by mixing of the fuel and air. All this happens over a relatively short longitudinally extending distance of entrainment passage 38 i.e. the distance between jet nozzle 75 and swirl plate 15 about 4 to 6 inches. Thus the fuel and air is metered and mixed prior to entering swirl plate 15. This is a much more accurate and precise arrangement than that disclosed in my '883 patent and importantly permits excessively low turn down ratios without carbon sooting. Again while the overall mass flow rates of fuel and air can be metered by master controller 68, the entrainment is causing a precise, discrete quantity of air/fuel to be drawn together and subsequently mixed. This produces a much higher intimate mixing than that which can be achieved by simply creating turbulence in fuel/air streams admitted to entrainment passage 38. In other words a turbulator in entrainment passage 38 will not produce the intimate mixing achieved by jets 77. At the same time a turbulator in entrainment passage 38 will produce better mixing than that heretofore achieved and the use of a turbulator in combination with swirl plate mixing as hereinafter described falls within the broad two stage mixing concept of the invention.

When the fuel/air mixture enters vane chambers 45 and radially travels to throat passage 17 the turbulence continues as the chambers decrease in size to ensure a thorough and complete mix of the fuel and air prior to entering entry end 18 of throat passage 17. That is the pressure drops caused by the small outlets formed by adjacent vane segments 43 at central opening establishes a back pressure within vane chambers 45 whereat further mixing of fuel and air occurs. However the fuel and air have already been mixed by jet nozzles 75. Thus the second step or stage or mixing in vane chambers 45 positively insures that the mixture is thoroughly and intimately mixed when it enters throat passage 17. The fuel/air mixture is thus intimately mixed when it enters throat passage 17 at entry end 18 and at that point, an ignitor 80 such as a flame rod extending from closed axial end 29 provides ignition to the fuel/air mixture. Ignited swirling mixture longitudinally travels down first cylindrical section 20 where it expands at intermediate step opening 22 which provides the stabilization point for the flame front. The mass flow and exit jet speed established by master controller 68 is sufficient to cause a high enough swirl speed so that burner stabilization is good over a wide turn down range i.e. a range extending from about 5.0 (cold air) or 5.5 (preheated air) to 1 (air to fuel) to as high as 12 to 1. Further, because of the general arrangement of block 11 and housing 12 with the step stabilization point it is possible to easily provide a sight glass port through opening 82 in interior cylinder 27 so that burner performance can be easily monitored.

Importantly and somewhat significantly, additional mixing does not occur at the flame stabilization point. It is well known that when the swirling mass of the ignited fuel/air mixture expands into second cylindrical section 22 a portion of the mixture recirculates back so that the flame front attaches to the step at the intersection 85 (stabilization point) of second cylindrical section 17 with frusto conical section 22. If the mixture is not thoroughly mixed prior to ignition, then additional mixing at the stabilization step would occur during the recirculation which produces some turbulence. Assuming that the fuel/air mixture was not intimately and thoroughly mixed when it left swirl plate 15, two things would happen at stabilization point 85. First varying proportions of fuel and air masses would come into contact so that irrespective of the total mass ratios of fuel and air admitted to the burner, at any instantaneous moment, substoichiometric or excess air combustion will take place producing temperature spikes well in excess of 2800° F. with the result that $NO_x$ will form. Second, the converse can also occur, with the result that incomplete combustion will not occur and free carbon will form. Thus the worst of both cases can and will happen. Free carbon and $NO_x$ will simultaneously form. It is the underpinning of the invention to positively insure that thorough mixing occurs prior to ignition so that recirculation at the stabilization step 85 will not cause additional mixing in the sense that because the air/fuel mixture is already mixed further, inherently-occurring mixing at the stabilization point will have absolutely no effect or change on the mixed air/fuel mixture. As discussed above, the two stage mixing employed in the invention positively insures thorough mixing, although it is possible and within the scope of the invention that for any particular air/fuel ratio a jet nozzle arrangement can be developed which, in and of itself, will produce the intimate and thorough mixing desired.

As noted above and referring to the concepts disclosed in my '921 patent, master controller 68 will control the overall mass flow rate of air/fuel to produce substoichiometric combustion of the air and fuel i.e. less than about 9.2 to 1. Further when preheated primary combustion air of 1200° F. is used master controller 68 will control the air to fuel ratio at 5.5 to 1 which will not produce $NO_x$. The products of combustion leaving throat passage 17 will have combustibles, CO and $H_2$ present. The amount of combustibles present can be conventionally determined or set forth in my '921 patent. In accordance with my '921 patent, secondary air will be metered downstream of burner 10 to complete staged combustion of the CO and $H_2$ without driving the temperature above 2800° F. This can be done in a controlled manner by simply providing an extension to refractory block 11 (not shown). In that extension secondary air jets 90 schematically illustrated in FIG. 1 can be employed. Alternatively, the structure shown in my '921 patent may be employed to complete combustion. Alternatively, the furnace structure within which the burner fires may have zones in which secondary and tertiary air jets can be positioned which will cause staged combustion to proceed. See for example my U.S. Pat. No. 3,819,323 for a furnace with a zone concept. In heat treat processes covered by my '323 patent, the furnace atmosphere must be rich at one zone followed by progressively leaner zones which the work experiences while it is heat treated.

Because of the mixing of air/fuel prior to ignition in combination with the swirl in block 11, burner 10 can operate over a very wide turn down ratio and can operate at stoichiometric and excess air conditions. When operated at these conditions, flame temperatures in excess of 2800° F. will occur and $NO_x$ formations will inherently result. However, the temperature of the products of combustion of the fuel/air mixture will be more constant with burner 10 of the present invention than those of prior art burners. The efficiency will be better, and the burner will lend itself to other $NO_x$ control approaches such as steam injection better than prior art burners where the air/fuel mixture continues to mix into combustible proportions after injection into the burner block.

The invention has been described with reference to a preferred embodiment. It will be obvious to those skilled in the art upon reading and understanding the invention to make alterations and modifications thereto. For example, it should be apparent that the plurality of jet nozzles 75 could be replaced by an annular jet slit which could be mounted even at the closed end of entrainment passage 38 and thus direct an annular jet within the entrainment passage. A still further modification would be to reverse the air and fuel so that combustion jets of air would entrain the fuel. However such reverse construction would not be suitable for preheated air or alternatively would require a ceramic swirl plate. It is intended to include all such modifications and alterations insofar as they come within the scope of the invention.

Having thus defined the invention, it is claimed:

1. A method for combusting a gaseous fuel with preheated air to products of combustion substantially free of $NO_x$ compounds comprising the steps of:

providing a refractory burner block with a throat passage extending therethrough, a burner housing having a longitudinally extending annular entrainment passage adjacent said block and a swirl plate interposed between said housing and said block providing fluid communication between said throat and entrainment passages;

supplying said preheated air at temperatures up to about 1250° F. to said entrainment passage;

supplying said fuel as free standing gas jets in said entrainment passage;

directing said gas jets of fuel towards said swirl plate to initially cause precise mixing by entrainment of said air with said fuel to form a desired air/fuel mixture while subsequently mixing said air and fuel as said jet streams of air/fuel mixture radially expand into contact with the walls of said entrainment passage and directly colliding said free standing jets with said swirl plate to cause turbulent mixing of air and gas;

swirling said air/fuel mixture within said swirl plate while causing a pressure drop of said fuel/air mixture to thoroughly mix said air/fuel mixture when said air/fuel mixture leaves said swirl plate and enters said throat passage;

igniting said fuel/air mixture after it leaves said swirl plate and enters said throat passage; and controlling the mass ratio so that the products of combustion produced by said burner include combustibles such as CO and $H_2$ in quantities sufficiently high to prevent adiabatic flame temperatures in excess of 2800° F. whereby formation of $NO_x$ compounds are minimized.

2. The method of claim 1 further including the steps of providing a radially outwardly displaced step in said throat passage, directing said swirling mass of air/fuel mixture to longitudinally flow past said step whereat said swirling mass radially expands into recirculating contact with said step and stabilizes the burner flame at said step, said recirculating contact insufficient to cause additional mixing at said step sufficient to form free carbon deposits thereat.

3. The method of claim 2 further including the step of controlling the speed of said gas jet to control the mass of air and mass of fuel entrained by said jet streams prior to mixing therebetween.

4. An industrial gas burner comprising:

a) a burner block having a throat passageway extending therethrough;

b) a burner housing attached to said block having an annular entrainment passage therein;

c) means to provide primary combustion air and a gaseous fuel to said entrainment passage;

d) jet nozzle means to cause a jet stream of one of said air and said fuel and entrainment and mixing of said air and said fuel in said entrainment passage;

e) swirl plate means in fluid communication with said entrainment and said throat passage for causing further mixing of said air and fuel prior to injecting said air and fuel into said throat passage; and f) means for igniting said air and fuel in said throat passage.

5. A lox $NO_x$ burner comprising:

a refractory burner block having a throat passage longitudinally extending therethrough from an entry end to an exit end;

a longitudinally extending burner housing generally adjacent said burner block having an annular, entrainment passage formed therein, said entrainment passageway generally longitudinally-aligned with said throat passage;

a preheated air chamber in fluid communication with said entrainment passage;

a plurality of gas jet nozzles spaced at circumferential increments within said entrainment passage, each nozzle having a jet axis oriented generally parallel to said entrainment passage's longitudinal axis;

a gas swirl plate at one axial end of said entrainment passage, said swirl plate having a plurality of radially extending vane passages perpendicular to said entrainment passage, each vane passage in fluid communication at its outlet with said entry end of throat passage and at its inlet with said entrainment passage;

means for supplying gas under pressure to said gas jets for causing gas emanating therefrom as free standing right angle conical gas jets to meter and mix said gas with said combustion air in said entrainment passage and further turbulently mix said gas and air in said vane passages into a combustible mixture of fuel and air when entering said throat passage's entry end; and igniter means at said throat passage's entry end for igniting said combustible mixture after leaving said burner housing.

6. The burner of claim 5 wherein said throat passage is cylindrical in shape and has a first longitudinally-extending section of a first diameter adjacent said entry end, a second longitudinally extending section adjacent said exit end of diameter larger than said first diameter and an intermediate step section between said first and second section whereby the intersection of said second section with said step section provides a flame stabilization point for said burner.

7. The burner of claim 5 wherein said housing includes a longitudinally extruding closed end cylinder concentrically disposed about a longitudinal centerline of said housing, said housing's longitudinal centerline axially aligned with the longitudinal centerline of said refractory block; said cylinder longitudinally extending to and abutting said swirl plate and closing said inlet end of said throat passage, and said cylinder having an outside diameter defining the innermost diameter of said entrainment passage.

8. A lox $NO_x$ burner comprising:

a refractory burner block having a throat passage longitudinally extending therethrough from an entry end to an exit end;

a longitudinally extending burner housing generally adjacent said burner block having an annular, entrainment passage formed therein, said entrainment passageway open at one axial end and closed at its opposite axial end and generally longitudinally-aligned with said throat passage;

a preheated air chamber in fluid communication with said entrainment passage;

a plurality of gas jet nozzles spaced at circumferential increments within said entrainment passage, each nozzle having a jet axis orientated generally parallel to said entrainment passage's longitudinal axis;

a gas swirl plate interposed between said burner housing and said burner block and having a plurality of radially extending vane passages, each vane passage in fluid communication with said throat passage and said open end of said entrainment passage;

means for supplying preheated combustion air to said preheated air chamber;

means for supplying gas under pressure to said gas jets for causing gas emanating from said gas jets to entrain and mix with said combustion air in said entrainment passage and further mix in said vane passages into a combustible mixture of fuel and air at said throat passage's entry end;

igniter means at said throat passage's entry end for igniting said combustible mixture, and said swirl plate has a central opening concentric with said throat passageway, an annular base portion extending radially outwardly from said opening, a plurality of radially extending vane segments longitudinally protruding from said base portion and defining a vane chamber between adjacent vane segments, each vane chamber having an area which progressively increases as the radial distance of said vane chamber extends further away from said central opening whereby said fuel and air mixture undergoes a pressure drop as it exits said vane chambers to cause further mixing of the air/fuel mixture in said vane chambers.

9. The burner of claim 8 wherein said vane segments extend longitudinally from said central opening whereby a swirl is imparted to said fuel and air mixture.

10. The burner of claim 9 wherein each vane segment longitudinally extends from said base portion at an angle thereto whereby said swirling fuel and air mixture travels longitudinally in said throat passage from said entry end to said exit end.

11. The burner of claim 9 wherein said swirl plate has a longitudinally offset collar portion, said housing having a gas chamber in fluid communication with said collar portion; a dividing wall in said gas chamber dividing said gas chamber into a high pressure chamber in fluid communication with said collar portion and a receiving chamber adjacent said high pressure chamber; each gas jet nozzle including a jet tube extending from said jet nozzle into said high pressure chamber and aperture means in said dividing wall for directing a jet stream of said gaseous fuel into said high pressure chamber for pressurizing same and simultaneously impinging said collar portion for cooling said swirl plate whereby said swirl plate may be formed of steel despite burner temperatures.

12. The burner of claim 11 wherein said swirl plate is a casting, said gas chamber longitudinally extending from said collar portion and concentric with and spaced radially outwardly from said entrainment passage, and said aperture means includes a plurality of orifices spaced at circumferential increments about said dividing wall.

13. The burner of claim 12 wherein said throat passage is cylindrical in shape and has a first longitudinally-extending section of a first diameter adjacent said entry end, a second longitudinally extending section adjacent said exit end of diameter larger than said first diameter and an intermediate step section between said first and second section whereby the intersection of said second section with said step section provides a flame stabilization point for said burner.

14. A lox $NO_x$ burner comprising:

a refractory burner block having a throat passage longitudinally extending therethrough from an entry end to an exit end;

a longitudinally extending burner housing generally adjacent said burner block having an annular, entrainment passage formed therein, said entrainment passageway open at one axial end and closed at its opposite axial end and generally longitudinally-aligned with said throat passage;

a preheated air chamber in fluid communication with said entrainment passage;

a plurality of gas jet nozzles spaced at circumferential increments within said entrainment passage, each nozzle having a jet axis oriented generally parallel to said entrainment passage's longitudinal axis;

a gas swirl plate interposed between said burner housing and said burner block and having a plurality of radially extending vane passages, each vane passage in fluid communication with said throat passage and said open end of said entrainment passage;

means for supplying gas under pressure to said gas jets for causing gas emanating from said gas jets to entrain and mix with said combustion air in said entrainment passage and further mix in said vane passages into a combustible mixture of fuel and air at said throat passage's entry end;

igniter means at said throat passage's entry end for igniting said combustible mixture, and said swirl plate has a longitudinally offset collar portion, said housing having a gas chamber in fluid communication with said collar portion; a dividing wall in said gas chamber dividing said gas chamber into a high pressure chamber in fluid communication with said collar portion and a receiving chamber adjacent said high pressure chamber; each gas jet nozzle including a jet tube extending from said jet nozzle into said high pressure chamber and aperture means in said dividing wall for directing a jet stream of said gaseous fuel into said high pressure chamber for pressurizing means and simultaneously impinging said collar portion for cooling said swirl plate whereby said swirl plate may be formed of steel despite burner temperatures.

15. The burner of claim 14 wherein said swirl plate is a casting, said gas chamber longitudinally extending from said collar portion and concentric with and spaced radially outwardly from said entrainment passage, and said aperture means includes a plurality of orifices spaced at circumferential increments about said dividing wall.

16. The burner of claim 15 wherein said housing includes a longitudinally extruding closed end cylinder concentrically disposed about a longitudinal centerline of said housing, said housing's longitudinal centerline axially aligned with the longitudinal centerline of said refractory block; said cylinder longitudinally extending to and abutting said swirl plate and closing said inlet end of said throat passage, and said cylinder having an outside diameter defining the innermost diameter of said entrainment passage.

17. A lox $NO_x$ burner comprising:

a refractory burner block having a throat passage longitudinally extending therethrough from an entry end to an exit end;

a longitudinally extending burner housing generally adjacent said burner block having an annular, entrainment passage formed therein, said entrainment passageway open at one axial end and closed at its opposite axial end and generally longitudinally-aligned with said throat passage;

a preheated air chamber in fluid communication with said entrainment passage;

a plurality of gas jet nozzles spaced at circumferential increments within said entrainment passage, each nozzle having a jet axis orientated generally parallel to said entrainment passage's longitudinal axis;

a gas swirl plate interposed between said burner housing and said burner block and having a plurality of radially extending vane passages,. each vane passage in fluid communication with said throat passage and said open end of said entrainment passage;

means for supplying preheated combustion air to said preheated air chamber;

means for supplying gas under pressure to said gas jets for causing gas emanating from said gas jets to entrain and mix with said combustion air in said entrainment passage and further mix in said vane passages into a combustible mixture of fuel and air at said throat passage's entry end;

igniter means at said throat passage's entry end for igniting said combustible mixture, and said throat passage is cylindrical in shape and has a first longitudinally-extending section of a first diameter adjacent said entry end, a second longitudinally extending section adjacent said exit end of diameter larger than said first diameter and an intermediate step section between said first and second section for providing a flame stabilization point for said burner and said step section is frustoconical in configuration extending at about an angle of 45° between said first and second sections.

18. Industrial burner apparatus comprising:

a refractory burner block having a longitudinally extending throat passage extending therethrough;

a longitudinally extending burner housing adjacent said block and having a longitudinally extending annular entrainment passage formed therein;

means to provide preheated primary combustion air to said entrainment passage at temperatures as high as about 1250° F.;

means to supply a gaseous fuel to said burner housing;

gas jet means in fluid communication with said gas supply means for forming a plurality of circumferentially spaced jet streams of gaseous fuel within said entrainment passage for entraining and mixing said fuel and air in said entrainment passage into a combustible fuel/air mixture;

swirl means interposed between said entrainment passage and said block providing fluid communication between said entrainment passage and said throat passage and effective to cause swirling and further mixing of said combustible fuel/air mixture;

ignition means adjacent said swirl means within said throat passage for igniting said fuel/air mixture; and controller means for causing said preheated air and said gaseous fuel to be admitted into said entrainment chamber at substoichiometric ratios whereby said burner produces products of combustion rich in combustibles.

19. Burner apparatus of claim 18 further including staged combustion means downstream of said throat passage for combusting said combustibles.

20. Industrial burner apparatus comprising:

a refractory burner block having a longitudinally extending throat passage extending therethrough;

a longitudinally extending burner housing adjacent said block and having a longitudinally extending annular entrainment passage formed therein;

means to provide preheated primary combustion air to said entrainment passage at temperatures as high as about 1250° F.;

means to supply a gaseous fuel to said burner housing;

gas jet means in fluid communication with said gas supply means for forming a plurality of circumferentially spaced jet streams of gaseous fuel within said entrainment passage for entraining and mixing said fuel and air in said entrainment passage into a combustible fuel/air mixture;

swirl means interposed between said entrainment passage and said block providing fluid communication between said entrainment passage and said throat passage and effective to cause swirling and further mixing of said combustible fuel/air mixture;

ignition means adjacent said swirl means within said throat passage for igniting said fuel/air mixture; and controller means for causing said preheated air and said gaseous fuel to be admitted into said entrainment chamber at substoichiometric ratios whereby said burner produces products of combustion rich in combustibles;

stages combustion means downstream of said throat passage for combusting said combustibles; and said substoichiometric ratio is as low as 5.5 parts of combustion air to 1 part of natural gas.

21. Burner apparatus of claim 20 wherein said jet streams ar freely expanding, right angle conical jets having velocities in excess of 10,000 feet per minute.

22. Burner apparatus of claim 20 wherein said throat passage is cylindrical in shape and has a first longitudinally-extending section of a first diameter adjacent said entry end, a second longitudinally extending section adjacent said exit end of diameter larger than said first diameter and an intermediate step section between said first and second section whereby the intersection of said second section with said step section provides a flame stabilization point for said burner.

* * * * *